United States Patent [19]

Perraud

[11] 4,326,449

[45] Apr. 27, 1982

[54] DOUBLE ACTING HYDRAULIC JACK WITH AN END OF STROKE DEVICE

[75] Inventor: Raymond Perraud, Villeurbanne, France

[73] Assignee: Societe d'Etude et de Construction de Machines pour Toutes Industries S.E.C.O.M.A., Societe Anonyme, Meyzieu, France

[21] Appl. No.: 133,831

[22] Filed: Mar. 25, 1980

[30] Foreign Application Priority Data

Apr. 6, 1979 [FR] France ..... 79 09554

[51] Int. Cl.[3] ..... F15B 15/22

[52] U.S. Cl. ..... 91/401; 92/111

[58] Field of Search ..... 91/401, 224, 229; 92/110, 111

[56] References Cited

U.S. PATENT DOCUMENTS

| | | | |
|---|---|---|---|
| 3,259,026 | 7/1966 | Madland et al. | 91/401 |
| 3,315,570 | 4/1967 | Brewer et al. | 91/401 |
| 3,998,132 | 12/1976 | Rasigade | 91/401 |
| 4,105,081 | 8/1978 | Perroud | 175/122 |

FOREIGN PATENT DOCUMENTS

| | | | |
|---|---|---|---|
| 1062300 | 4/1954 | France . | |
| 1125999 | 7/1956 | France | 91/401 |
| 1475087 | 2/1967 | France . | |
| 2200451 | 4/1974 | France . | |
| 1126725 | 9/1968 | United Kingdom . | |
| 1297236 | 11/1972 | United Kingdom . | |
| 1378363 | 12/1974 | United Kingdom . | |

*Primary Examiner*—Paul E. Maslousky
*Attorney, Agent, or Firm*—Karl F. Ross

[57] ABSTRACT

A double-acting hydraulic jack has a cylinder, a piston dividing the cylinder into first and second chambers of variable volume on opposite sides of the piston, and a piston rod with first and second passages opening into the first and second chambers respectively. The piston is moved by supply of pressurized fluid to one passage or the other. An end-of-stroke device is provided to relieve the high pressure applied to the first chamber when the piston comes to the end of its stroke under the action of the pressure fluid supplied to that chamber through the first passage. The device comprises a bore in the piston. The axis of the bore is parallel to the piston axis. The bore contains a small moveable rod urged to project from the bore into the second chamber by high fluid pressure taken from the first passage to move a sliding sleeve in the bore. This sleeve movement is transmitted to urge the small rod and also blocks a third passage leading to the bore from the first passage. The small rod projecting into the second chamber swept by the piston is brought into abutment with an end of the cylinder causing the rod to move back into the bore. This rod movement is transmitted to the sleeve which opens the third passage through which the high pressure in the first passage is relieved via the bore and an ever open fourth passage between the bore and second chamber.

7 Claims, 5 Drawing Figures

DOUBLE ACTING HYDRAULIC JACK WITH AN END OF STROKE DEVICE

FIELD OF THE INVENTION

This invention relates to a double acting hydraulic jack supplied with hydraulic fluid through its piston rod, in combination with an end of stroke device.

BACKGROUND OF THE INVENTION

In certain hydraulic drilling apparatus, in particular rotary/percussion apparatus, the "percussion" function is initiated by the propulsion pressure. Thus the pressure at which the jack for the propulsion of the drill is supplied with hydraulic fluid serves to control the striking of a hammer in the form of a piston, for example by providing that:

as long as said pressure has not reached a certain threshold, the rate of flow of hydraulic fluid controlling the percussion movement is nil;

as soon as this pressure threshold is reached, the rate of flow of hydraulic fluid controlling the percussion movement is brought to a value facilitating "low percussion";

beyond this pressure threshold, the rate of flow increases progressively and in proportion to the pressure in order to achieve operating conditions of "normal percussion".

This self-regulation makes it possible to pass from operating condtions of "low percussion" for starting a hole, to operating conditions of so-called "normal percussion" for normal drilling. However, when at the end of drilling the hole, the propulsion jack approaches the end of its stroke, the system alone is unable to prevent an idle percussion stroke which is useless, leads to deterioration of the apparatus, in particular damage to the tip of the drill, causes heating of the hydraulic fluid and is noisy. In this respect, it should be noted that the association of a simple pressure limiter with the propulsion jack is not sufficient to eliminate these drawbacks, since a device of that type is not able to cancel out the propulsion pressure.

OBJECT OF THE INVENTION

In view of the aforementioned, an object of the invention is to provide a device which, at the end-of-the stroke of a double-acting hydraulic jack supplied with hydraulic fluid through its piston rod, is able to connect the two chambers of the jack.

SUMMARY OF THE INVENTION

According to the invention there is provided a double-acting hydraulic jack in combination with an end-of-stroke device, the jack having a cylinder, a piston slidable in the cylinder to vary the volume of first and second chambers at opposite sides of said piston in the cylinder, the jack being supplied with hydraulic fluid through a piston rod. According to the invention the piston has a bore whose axis is parallel to the axis of the jack, a permanently open first conduit arrangement between an end of the bore and a passage in the rod through which passage hydraulic fluid is supplied to the first chamber, a second conduit arrangement between a central region of the bore and the passage, the second conduit arrangement being provided with a non-return (check) valve to prevent a permanently open third conduit arrangement between the second chamber and a region of the bore opposite said end of the bore, a sleeve mounted to slide in the bore to close and open an outlet which opens into the bore from the second conduit arrangement, a second rod mounted to slide along the axis of the bore, the second rod passing through an opening connecting the bore to the second chamber. The second rod comprises a head mounted to slide inside the sleeve, a helical spring disposed around the second rod and interposed between the sleeve and an abutment fixed to the second rod, an end of said second rod passing through the opening and being able to come into abutment with an end of the cylinder located adjacent the second chamber when the jack is in an end of stroke position.

The end-of-stroke device is mounted in the piston of the jack and is completely integrated with the jack. The second conduit arrangement comprising the non-return valve allows a flow of hydraulic fluid in one direction which flow, creating a certain pressure drop, causes a pressure to prevail on one end of the sleeve, which is less than the pressure existing on the other end of the sleeve i.e. the higher pressure being on the end of the sleeve adjacent the end of the bore where the first conduit arrangement is provided, which first arrangement may be formed by a simple bore extending radially of the piston. This pressure difference causes the sleeve to close off the outlet from the second conduit arrangement in order to allow the jack to operate in one direction, for example that of extension of the piston rod. At the end of this movement, the second rod in the end of stroke device comes into abutment with one end of the jack cylinder, for example the bearing through which the piston rod passes. This abutment moves the second rod which, through the intermediary of the spring, moves the sleeve so as to re-open the outlet and re-establish the connection between the high and low pressure circuits in which the passage and second chamber are respectively included. Thus the desired pressure drop at the end of the stroke is created. When controlling the movement of the rod of the jack in the opposite direction, for example for the retraction of the piston rod, the non-return valve recloses the connection between the high and low pressure circuits and allows the retraction to be carried out effectively. The end-of-stroke device thus arranged does not disturb the operation of the jack during the extension and retraction of the piston rod.

BRIEF DESCRIPTION OF THE DRAWING

The invention will now be further described, by way of example, with reference to the accompanying diagrammatic drawing in which.

SPECIFIC DESCRIPTION

Figure 1:
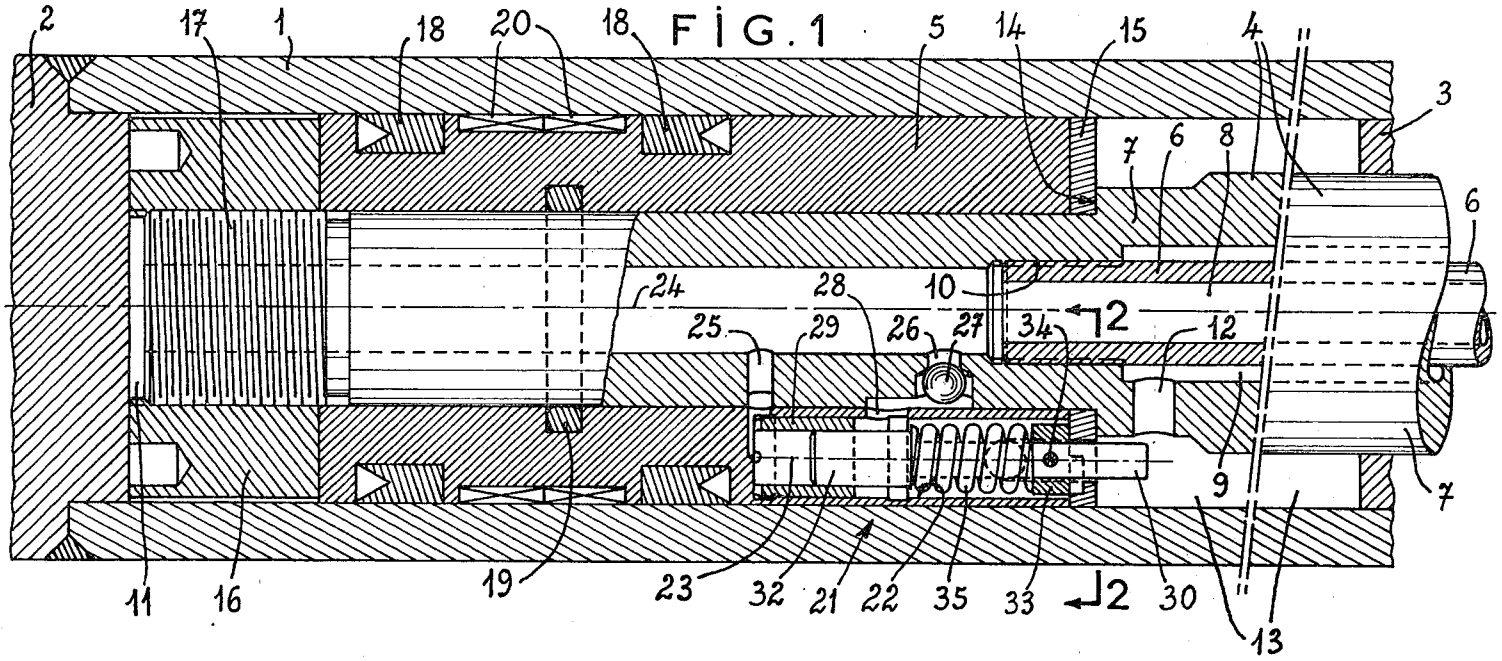
FIG. 1 is a general view, in longitudinal section, of a hydraulic jack equipped with an end-of-stroke device in a combination formed according to the invention.
Figure 2:
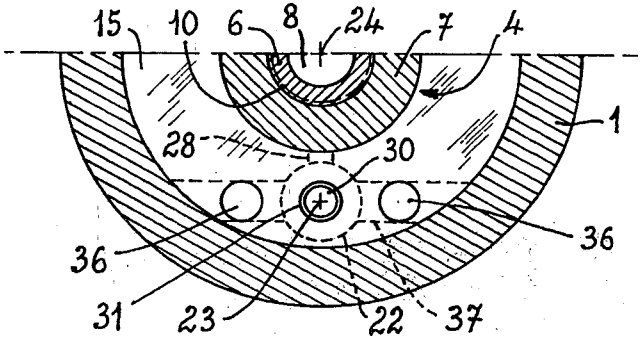
FIG. 2 is a fragmentary view in cross-section on line 2—2 of FIG. 1.

The double-acting hydraulic jack illustrated in FIGS. 1 and 2, comprises a cylindrical body 1 closed at one end by a base 2 and its other end comprising a head 3 forming a bearing through which a piston rod 4 passes, which rod is integral with a piston 5 mounted to slide inside the body 1.

In known manner, the rod 4 is constituted by two coaxial tubes 6 and 7 which define a central passage 8 and an annular passage 9 allowing the jack to be supplied with hydraulic fluid through the piston rod. The inner tube 6 is screwed into a tapped thread 10 on the outer tube 7, close to the end of the rod 4 which supports the piston 5. Thus the central passage 8 opens directly into a first chamber 11, defined by the body 1, the base 2 and the piston 5, whereas the annular passage 9 opens through the intermediary of a radial bore 12 in the outer tube 7 into a second chamber 13 which is defined by the body 1, the bearing 3 and the piston 5.

The piston 5 is mounted on a terminal part of reduced diameter of the tube 7 of the rod 4, defined by a shoulder 14. This piston 5 is immobilized axially, with respect to the rod 4, between a ring 15 pressed against the said shoulder 14 and a nut 16 screwed onto a screw thread 17 provided at the end of the tube 7. Gaskets 18, 19 and bearing rings 20 are interposed on the one hand between the piston 5 and the body 1, on the other hand between the piston 5 and the tube 7 of the rod 4, these gaskets and rings being housed in annular grooves in the piston.

The end of stroke device designated generally by reference numeral 21, is essentially mounted in a cylindrical bore 22 in the piston 5, this bore 22 having its axis 23 parallel to the axis 24 of the jack and opening out on the face of the piston 5 which is pressed against the ring 15.

A radial bore 25 in the tube 7 and partly in the piston 5 connects the central passage 8 of the rod 4 of the jack to a bottom end of the bore 22. Another connection between the central passage 8 of the rod 4 and the central region of the bore 22, is formed by a stepped bore 26 in the tube 7. The step in the bore 26 forms a seat for a simple ball 27 of a non-return ball valve. The bore 26 is extended by a hole 28 which passes through the narrowest part of the piston 5 between the rod 4 and the bore 22.

A sleeve 29 is mounted to slide in the part of the bore 22 located closest to the bottom end of the bore. A small rod 30 is also mounted to slide along the axis 23 of the bore 22. One end of this rod 30 passes with a certain clearance through a circular opening 31 provided in the ring 15. The other end of the rod 30 comprises a cylindrical head 32, mounted to slide inside the sleeve 29.

A ring 33 is mounted on the rod 30, this ring being axially immoveable relatively to the rod due to its connection thereto by cotter-pin 34. The ring 33 is housed inside the bore 22, between the ring 15 and the sleeve 29. A helical spring 35, mounted around the small rod 30, is interposed between the sleeve 29 and the ring 33.

Two holes 36 are also provided in the piston 5 and the ring 15. The axes of these holes are parallel to the axis 23. The holes 36 are on opposite sides of the bore 22 and open into the chamber 13. Both holes 36 communicate, through the intermediary of a bore 37 in the piston 5, with the interior of the bore 22 to which the bore 37 extends transversely.

In order to describe the operation of the end of stroke device 21, it will be assumed that initially the rod 4 of the jack is completely retracted within the body 1, the nut 16 which retains the piston 5 coming into abutment with the cover 2 (see FIG. 1). The sliding sleeve 29 is thus located at the bottom end of the bore 22.

In order to control the extension of the rod 4 with respect to the body 1, hydraulic fluid under high pressure is sent through the central passage 8 to the chamber 11. The other chamber 13 is connected to low pressure through the intermediary of the radial bore 12 and the annular passage 9.

Thus, when the extension movement of the rod 4 is effected, a connection between the high pressure circuit and the low pressure circuit, more precisely between the central passage 8 and the chamber 13, is ensured by the bore 26 (where the non-return valve comprising the ball 27 is open), the bore 22, the bore 37 and the holes 36 (the hole 28 not being closed by the sleeve 29). A flow of hydraulic fluid between the central passage 8 and the chamber 13 is thus permitted initially.

An annular end face of the sleeve 29 facing the bottom end of the bore 22 is thus subject to a pressure P which in practice is equal to the high pressure of the fluid in the central passage 8, taking into account the connection ensured by the bore 25 and owing to the fact that no flow is possible through this bore. On the other hand, the pressure drop $\Delta P$, due to the flow which takes place initially through the bore 26 and the hole 28, creates a lower pressure $P-\Delta P$ at the other end of the sleeve 29, this lower pressure acting on the annular end face at this other end.

Figure 3:
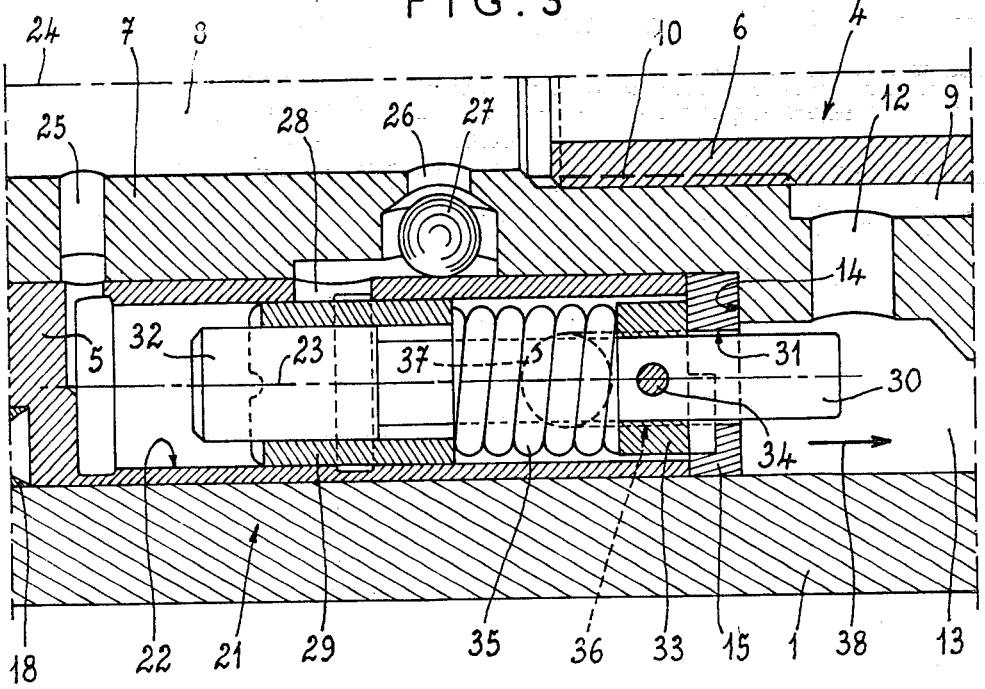
FIG. 3 is a fragmentary view in longitudinal section and on an enlarged scale, of the end of stroke device in FIG. 1, in its position occupied during extension of the piston rod.

Owing to this pressure difference between opposite ends of the sleeve 29, the latter is pushed in the direction which moves it away from the bottom end of the bore 22, until it comes to bear against the end of the spring 35. As shown in FIG. 3, the sleeve 29 thus closes off the hole 28, interrupting the flow of hydraulic fluid, through the bore 26, between the central passage 8 of the rod 4 and the chamber 13. Since the leakage between the high pressure circuit and the low pressure circuit has ceased, all the fluid supplied through the central passage 8 is directed to the chamber 11 and causes the extension of the rod 4 of the jack, the piston 5 being moved in the direction indicated by arrow 38 in FIG. 3. It should be noted that the phenomenon described above accelerates owing to the fact that the pressure drop $\Delta P$ in question increases as the hole 28 is closed by the sleeve 29.

Furthermore, the movement of the sliding sleeve 29 causes the compression of the spring 35. By means of the ring 33, against which it is pressed, this spring 35 also moves the small rod 30, in order to cause the latter to project through the opening 31 in the ring 15.

This position is maintained throughout the extension movement of the rod 4.

Figure 4:
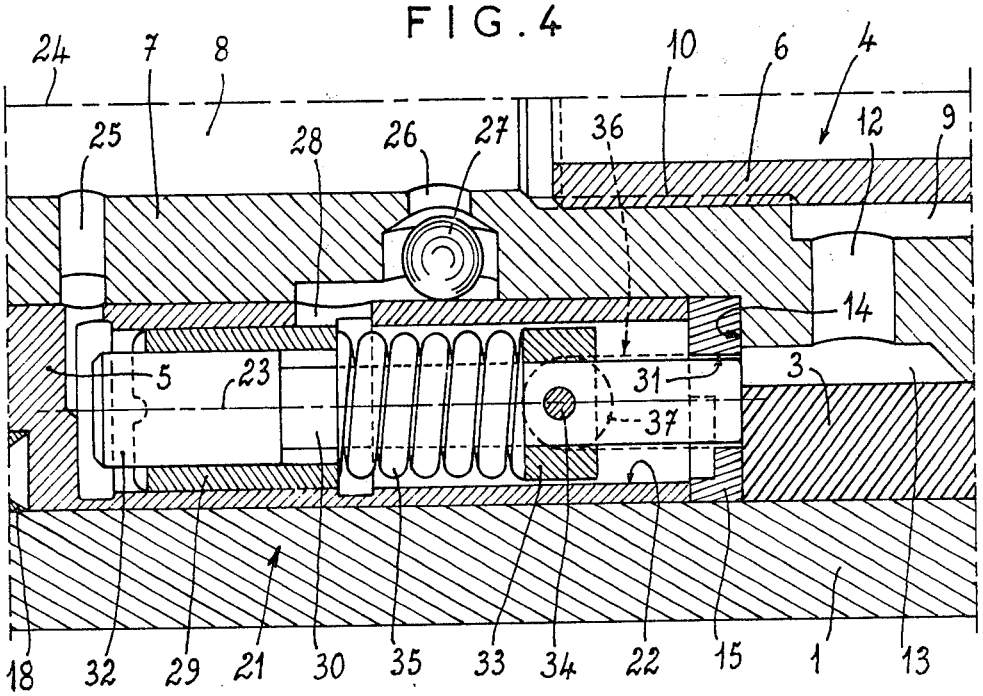
FIG. 4 is a view similar to the preceding view, but showing the end-of-stroke device in its position occupied when the piston rod is completely extended.

At the time when the rod 4 reaches the end of stroke position of this extension movement, the small rod 30 of the device 21 comes into abutment with the bearing 3 (see FIG. 4). The small rod 30 then re-enters the bore 22, through the opening 31.

By means of the ring 33 and the expansion of the spring 35, the movement of the small rod 30 then causes the sleeve 29 to slide in the direction of the bottom end of the bore 22. This movement of the sleeve 29 uncovers the hole 28, so that the central passage 8 and the chamber 13 are reconnected, by means of the bore 26, the hole 28, the bore 22, the bore 37 and the holes 36. The two chambers 11 and 13 of the jack are thus both at low pressure and any action for controlling the jack is automatically interrupted.

The function of the spring 35 is to store a certain amount of energy during the beginning of the extension phase of the rod 30 and to restore this energy at the time of the end of the extension stroke, when the sleeve 29 is located opposite the hole 28. It thus makes it possible to completely open the passage 8 to the chamber 13, via the hole 28, and thus to bring the pressure in the jack to a value less than the threshold allowing the initiation of the "percussion", in the case where the jack is used in hydraulic drilling apparatus.

Then, the sleeve 29 does not return to the bottom end of the bore 22, but it assumes a position of equilibrium at a certain distance from the bottom end, under the effect of the force of the spring 35 and of the pressure difference between the two annular end faces of the sleeve, a difference which results, as previously, from the pressure drop due to the flow through the bore 26 and the hole 28. The spring 35 is partly expanded. Thus, the spring also adopts a certain position of equilibrium, since it is subject on the one hand to its own tension force and on the other hand to the pushing force exerted by the sleeve 29, which tends to compress the spring, owing to the pressure difference which has been mentioned above.

In order to bring about the retraction of the rod 4 with respect to the body 1 of the jack, hydraulic fluid at high pressure is sent through the annular passage 9 to the chamber 13. The other chamber 11 is connected to low pressure through the intermediary of the central passage 8.

When (starting from the end of stroke position corresponding to full extension) the retraction movement of the rod 4 is initiated, there is a rise in pressure in the bore 22 which is connected to the chamber 13 and this causes the closure of the passage 26 by the non-return valve comprising the ball 27. Since the connection between the high pressure circuit and the low pressure circuit is thus interrupted, all the fluid supplied through the annular passage 9 fills the chamber 13 and causes the retraction of the rod 4, the piston 5 being moved in the direction indicated by arrow 39 in FIG. 5.

Pressurisation of the interior of the bore 22 moves the sliding sleeve 29 and the rod 30 with the head 32 to the bottom end of this bore. The spring 35 is expanded to the maximum.

Figure 5:
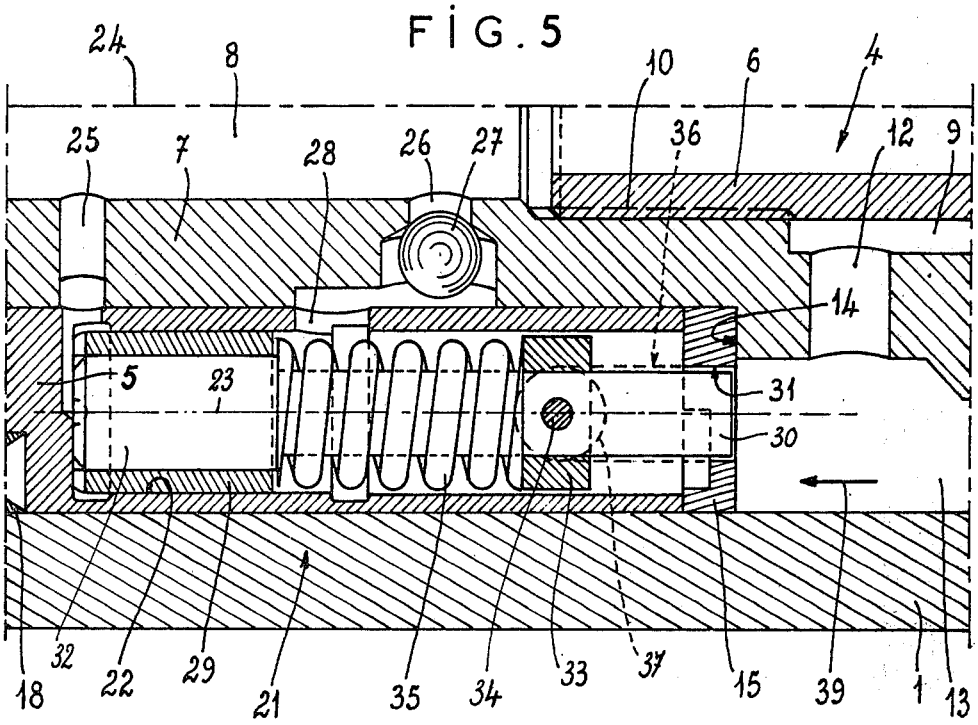
FIG. 5 is another view similar to the two preceding views, illustrating the end of stroke device in its position occupied during retraction of the piston rod.

This position, illustrated in FIG. 5, is maintained throughout the retraction movement of the rod 4. At the end of the retraction stroke, this position is maintained. The device is once more in the initial position for the beginning of a new operating cycle.

The invention has particular relevance to the propulsion jack of a drill, in hydraulic drilling apparatus where the "percussion" function is initiated by the propulsion pressure. In fact, by mounting the device 21 on the propulsion jack, one provides a drop in the propulsion pressure at the end of the stroke of the jack. The reduction in the propulsion pressure causes stoppage of percussion and thus prevents an "idle percussion stroke". Naturally jacks intended for other applications may be provided with the same end of stroke device.

What is claimed is:

1. In a double-acting hydraulic in combination with an end-of-stroke device, said jack having a cylinder, a piston slidable in the cylinder to vary the volume of first and second chambers at opposite sides of said piston in the cylinder, said jack being supplied with hydraulic fluid through a piston rod connected to said piston, the improvement wherein said piston is provided with a bore, the axis of said bore being parallel to the axis of the jack, a permanently open first conduit arrangement between an end of the bore and a passage in the rod through which passage hydraulic fluid is supplied to the first chamber, a second conduit arrangement between a central region of the bore and the passage, the second conduit arrangement being provided with a non-return valve to prevent the flow of hydraulic fluid from the bore to the passage, a permanently open third conduit arrangement between the second chamber and a region of the bore opposite said end of the bore, a sleeve mounted to slide in the bore to close and open an outlet which opens into the bore from the second conduit arrangement, a second rod mounted to slide along the axis of the bore, the second rod passing through an opening connecting the bore to the second chamber, said second rod comprising a head mounted to slide inside the sleeve, a helical spring disposed around the second rod and interposed between the sleeve and an abutment fixed to the second rod, and an end of said second rod passing through the said opening and being able to come into abutment with an end of the cylinder located adjacent the second chamber when the jack is in an end-of-stroke position.

2. The improvement defined in claim 1, in which the first conduit arrangement is a second bore extending radially of the piston.

3. The improvement defined in claim 1 wherein the non-return valve is a ball valve, and the second conduit arrangement is a stepped third bore forming a seat for a ball of the said ball valve.

4. The improvement defined in claim 1, claim 2 or claim 3, in which the third conduit arrangement comprises first and second holes in the piston, said holes having axes substantially parallel to the axis of the first mentioned bore and the holes being disposed on opposite sides of the first bore, said holes opening into said second chamber and communicating with the interior of the first bore through a fifth bore in the piston, said fifth bore extending transversely to the first bore.

5. The improvement defined in claim 1, claim 2 or claim 3, in which the opening through which the second rod passes is provided in a ring pressed by the piston against a shoulder on the piston rod.

6. The improvment defined in claim 1, claim 2 or claim 3, in which the spring is interposed between the sleeve and a ring fixed to the second rod.

7. The improvement defined in claim 1, claim 2 or claim 3, in which the first-mentioned bore opens out on the side of the piston which faces the second chamber adjacent a head of the jack, said head forming said end of the cylinder and a bearing for the piston rod, and the second rod being able to come into abutment with the bearing at the end of the extension stroke of the piston rod.

* * * * *